US006996947B2

(12) United States Patent
Albora

(10) Patent No.: US 6,996,947 B2
(45) Date of Patent: Feb. 14, 2006

(54) BUILDING PRODUCT USING AN INSULATION BOARD

(75) Inventor: Joseph A. Albora, River Edge, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 167 days.

(21) Appl. No.: 10/674,439

(22) Filed: Sep. 30, 2003

(65) Prior Publication Data

US 2005/0066620 A1 Mar. 31, 2005

(51) Int. Cl.
*E04C 2/00* (2006.01)

(52) U.S. Cl. ..... 52/796.1; 52/309.8; 52/783.1

(58) Field of Classification Search ..... 52/309.8, 52/309.9, 309.12, 794.1, 741.41, 783.1, 796.1; 442/372, 374; 428/316.6, 317.9, 318.4
See application file for complete search history.

(56) References Cited

U.S. PATENT DOCUMENTS 4,578,915 A * 4/1986 Schneller ..... 52/309.12
5,531,051 A * 7/1996 Chenier et al. ..... 52/255
5,647,180 A * 7/1997 Billings et al. ..... 52/268
6,698,149 B1 * 3/2004 Ruchgy ..... 52/309.4

* cited by examiner

*Primary Examiner*—Naoko Slack
(74) *Attorney, Agent, or Firm*—William J. Davis; Philip Braginsky

(57) ABSTRACT

A building product comprising a composite board having a cellular, non-elastic core, top and bottom board surfaces, and a facer comprising a non-cellulosic fiber mat substrate; and a water-based overlaying material applied to the composite board. The building product may also comprise an undersiding; a composite board having a cellular, non-elastic core and top and bottom board surfaces and facer comprising a non-cellulosic fiber mat substrate fixed to the undersiding; a reinforcing layer fixed to the board; and a water-based overlaying material applied to the reinforcing layer.

22 Claims, 2 Drawing Sheets

BUILDING PRODUCT USING AN INSULATION BOARD

BACKGROUND OF THE INVENTION

1. Field of the Invention

The invention relates to building materials and products, and, more particularly, to a vertical, water-based application on an insulation board assembly having non-cellulosic facers thereon.

2. Background of the Invention

Rigid polymeric foam insulation laminates have been used for many years by the construction industry. Uses include commercial roof insulation boards utilized under asphaltic built-up roof (BUR) membranes as well as under various single ply membranes such as EPDM rubber, PVC, modified bitumen membranes and the like. Other uses include residential insulation, as sheathing under siding, and as roof insulation under asphalt shingles and concrete tiles.

Such insulation often takes the form of a core polymeric foamed thermoset material such as polyurethane, polyisocyanurate, polyurethane modified polyisocyanurate (often referred to as polyiso) or phenolic resin, applied between two facing sheets.

The insulation boards are generally manufactured on production lines where a liquid core chemical mixture is poured over a bottom facer, foaming up to contact a top facer in a constrained rise laminator. The reaction of the chemical mixture causing foaming is generally exothermic, as curing via polymerization and crosslinking occurs in the laminator. In the case of polyisocyanurate insulation boards, the curing exotherm lasts well into the time the resulting rigid boards are cut, stacked and warehoused. The exotherm can continue for as long as 4 days and the mixture can reach temperatures as high as 325° F.

Desirable properties for the facers include water resistance or waterproof, flexibility, high tensile and tear strength as well as resistance to thermal degradation. The facer should prevent bleed-through of the liquid chemicals from the board prior to foaming. Additionally, facers should exhibit good adhesion to the core foam insulation and be inert to the effects of extraneous chemicals that may be present in the mixture, especially blowing agents that may also behave as solvents.

Traditionally, facer materials have included cellulose, asphalt saturated cellulosic felts, fiberglass mats, asphalt emulsion coated fiberglass mats, aluminum foil/Kraft/foil, glass fiber modified cellulosic felts, glass mats onto which polymeric films have been extruded, and glass mats coated with polymeric latex/inorganic binder coatings. However, all of these materials have undesirable properties. For example, cellulose facers degrade when exposed to water or water based cementious material. Asphalt-containing products are not compatible with PVC single ply roofing membranes. Fiberglass mats are subject to excessive bleed-through of foamable core chemicals. Aluminum facers and foils reflect heat into the foam during processing which leads to disruption of cell structure, delamination and warping. Further, foil faced sheathing and extrusion or lamination of a polymer film to glass mat surfaces are costly. Specifically, glass mats coated with polymer latex/inorganic binder mixtures have been found to be brittle; conversely, glass fiber modified cellulosic felts are susceptible to moisture absorption aggravating board warping in damp or wet environments.

For vertical building materials, expanded polystyrene ("EPS") board is commonly used as a sheathing. EPS is water resistant allowing for water based applications to be applied. However, EPS also has many deficiencies. EPS flows when heated, offers less insulation (has a lower "r" value) than polyiso, and is relatively fragile.

Polyiso is more tough and provides better insulation than EPS. However, polyiso with a paper facer is incompatible with water based applications since the paper expands and degrades when exposed to water.

The prior art boards and facers would all suffer from various problems as they relate to water-based cementatious vertical overlayments. Therefore, plywood and building paper has most often been used for such applications. As shown in FIG. 1, the prior art building product for water based vertical applications comprises a plywood undersiding board 2 fixed to a wood frame 4. A building paper 6 is applied over the undersiding that is typically an asphalt-saturated paper felt. A metal reinforcement or lath 8 is then typically installed by nail or staple to the structure. This metal mesh supports the cement plaster application 10 that may be applied to it in several layers. Acrylic finishes 12 may also be applied to such a vertical application. The prior art is undesirable since these materials are not water resistant or good insulators.

SUMMARY OF THE INVENTION

The present invention is directed to an insulation board, preferably of polyisocyanurate, comprising a non-cellulosic facer fixed to a board surface. To this is applied a water-based vertical overlaying material such as a cementations layer. Another embodiment of the present invention is directed to a vertical building product comprising a frame, an insulation board with one or more non-cellulosic facers attached to the frame, a reinforced lath attached to the board, and a cementatious layer applied to the lath.

Vertical applications include walls, doors, columns and other similar structures. Preferably the water based overlaying material used is a cementatious compound due to its low cost, ease of use, design flexibility and visual appeal. These may include Portland cement, stucco, finishing plasters and other exterior cladding systems.

The advantages of using a non-cellulosic, polyisocyanurate board of the present invention include: the elimination of an underlayment since the board has its own facer; the property that polyisocyanurate is self-extinguishing; it has greater compressive strength; it has superior nail pull through; and it has greater insulating value as compared to the prior art. Additionally, this composite requires low maintenance, is water resistant, integrates well with other materials and is highly durable as compared to the prior art.

The non-cellulosic facer of the present invention comprises a dry, preformed fibrous mat substrate on which is coated a pre-frothed or pre-foamed composition containing a natural or synthetic latex polymer, a surfactant(s) and an inorganic mineral filler. The composition may optionally contain up to about 15 wt. % of extraneous additives, which include a flame retardant, dye, thickener, porosity reducing agent, thermal and/or UV stabilizers and the like, to provide a foamed facer product having, on a dry weight basis, less than 50% fiber in the mat. The preferred facer product contains 30 to 46 wt. % of fiber in the composition consisting of mat fiber with binder and latex in the coating mixture.

DETAILED DESCRIPTION OF THE INVENTION

Figure 1:
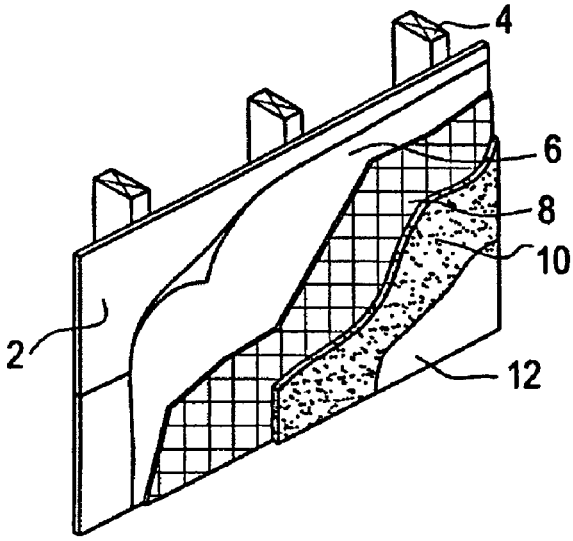
FIG. 1 (Prior Art)
FIG. 1 shows a prior art vertical application supported by a plywood undersiding board fixed to a wood frame.

Generally, the foamed coating composition applied to the preferred preformed mat contains on a dry weight basis between about 15 and about 80 wt. % of the polymer latex, between 0.01 and about 80 wt. % filler, between about 0.5 and about 10 wt. % foam supporting surfactant(s) and 0 to 15 wt. % extraneous additives. Appropriate facers and boards for the present invention are found in U.S. Pat. Nos. 6,365,533, 6,368,991 and pending U.S. application Ser. No. 10/117,912, which are incorporated herein by reference. However, the board and facers are not limited to these embodiments, any board and facer providing the same functionality can be used.

The fibers of the mat employed in this invention can include any of the non-cellulosic types, such as fibers of glass, polyester, polypropylene, polyester/polyethylene/terephthalate copolymers, hybrid types such as polyethylene/glass fibers and other conventional non-cellulosic fibers. Mats having glass fibers in random orientation are preferred for their resistance to heat generated during the manufacture of insulation boards and flame resistance in the finished product.

The fibrous mats of the invention, generally of between about 10 and about 30 mils thickness, can contain a binder that is incorporated during mat formation to fix the fibers in a self-sustaining solid web and to prevent loss of fibers during subsequent processing and handling. Such binders include phenol-, melamine- and/or urea-formaldehyde resins or mixtures thereof. Most preferred are mats having glass fibers in the range of from about 3 to about 20 microns, most desirably 10–18 microns, in diameter and a length of from about 0.25 to about 1.75 inch, most desirably a length of 0.75–1.5 inch.

The fillers that can be used in the present coating mixture include conventional inorganic types such as clays, mica, talc, limestone, kaolin, other stone dusts, gypsum, aluminum silicate (e.g. Ecca Tex 561), flame retardant aluminum trihydrate, ammonium sulfamate, antimony oxide, calcium silicate, calcium sulfate, and mixtures thereof.

Surfactants that can be employed in the coating composition are organic types suitable for stabilizing latices, such as, for example, ammonium salts of a $C_{10}$ to $C_{22}$ fatty acid, e.g. ammonium stearate (STANFAX 320 or other surfactant system). One or more surfactants can be employed in the coating composition to promote the formation of foam and to maintain the foam structure of the coating before curing.

The latex component of the coating composition includes latex polymers of natural rubber as well as synthetic latices including copolymers of styrene and butadiene and acrylic based resins. Representative examples of these are polyvinyl chloride, styrene/acrylic or methacrylic esters, ethylene/vinyl chloride and polyurethane, polyisoprene, polyvinylidene chloride, polyvinyl acetate/polyvinyl chloride and synthetic rubbers such as SBS, SBR, neoprene, etc. and any other latex polymer and mixtures of the foregoing.

The mat coating mixture of the invention can be obtained from a frothed or foamed 15–80 wt. % aqueous emulsion, dispersion or suspension, which is prefoamed by incorporating air in the aqueous liquid mixture, e.g. by blowing or mixing, with vigorous agitation in the presence or absence of a conventional blowing agent. The resulting frothed or foamed, aerated composition is then coated to a thickness of from about 5 to about 100 mils on the preformed mat surface under ambient conditions using a knife blade, a roller or any other convenient method of application. In one aspect, the foam coated mat is then dried at below its cure temperature to provide a foamed, self-supporting product having a reduced coating thickness of up to 90 mils which adheres to the mat surface. In another aspect, the foamed coated mat is dried and cured simultaneously.

The resulting facer product of this invention is flexible and possesses low permability to liquid chemicals used for insulation cores as well as superior dimensional stability and high tensile strength after curing. This product, comprising the mat having an adhered surface coating of a prefoamed latex/filler/surfactant, can be fed directly to insulation board manufacture, e.g. a constricted rise laminator, wherein the uncoated fiber surface of the mat contacts at least one exposed surface of a foamed or foamable thermosetting non-elastomeric core in the manufacture of an insulation board.

As indicated above, the foamed coating of the present facer can be formed in the absence or presence of a blowing agent to provide a composition of reduced density. Advantageously, the consistency of the foam is such that the coating mixture does not penetrate through the mat.

Generally the amount of air incorporated into the foamable mixture prior to coating can be between about 5% and about 80% by volume for optimal consistency and the resulting foamed mixture has bubble openings sufficiently small so as to inhibit liquid bleed through the mat.

The present latex coating composition can additionally contain a minor amount, up to 15%, preferably less than about 3 wt. %, of a conventional thickening agent, for example, an acrylic polymer thickener, e.g. (ACRYSOL ASE 95NP and/or 60NP) and the like. Other inert excipients such as a UV or thermal stabilizer, a conventional coloring agent, texturizing agent, reinforcing or crosslinking agent, (e.g. CYMEL 303 resin) and/or blowing agent may also be included in the coating mixture; although addition of these additives in a minor amount of less than 2 wt. % are preferred.

The coating composition preferably includes a catalyst to provide a faster cure and/or a harder, less abraidable finish. Suitable catalysts include diammonium phosphate (DAP), para-toluene sulfonic acid (PTSA), ammonium chloride, oxalic acid and the like, or combinations of the above. A preferred catalyst is FREECAT 187. The catalyst can be present in an amount up to 5 wt % and preferably between 0.01–4 wt % of the cured foam.

The insulation boards, for which the present facer is particularly suited, comprise conventional thermosetting or thermoplastic foam cores, such as foamed polyurethane or polyurethane modified polyisocyanurate or phenol-formaldehyde cores disposed between a pair of facer members which are fixed to the core surfaces. Other non-elastomeric foamable chemicals, such as polyvinyl chloride, polystyrene, polyethylene, polypropylene, and others conventionally employed as core material can also be employed as the insulation board core of this invention.

One of the facer sheets may be selected from those conventionally employed, such as for example a cellulose or cellulose-glass hybrid felt sheet, perlite, aluminum foil, multilaminated sheets of foil and Kraft, uncoated or coated fiber glass mats; although the second facer sheet of the present invention enhances the advantages described herein. As the core foam is spread on the fibrous surface of the first facer sheet entering the laminator, it undergoes an exothermic reaction. The core foam rises to contact the undersurface of the second facer and hardens thereon thus providing a rigid insulating foam core interposed between two facer sheets. The resulting product can then be cut into boards of desired size and shape. The heat of the exothermic reaction involving polymerization and/or crosslinking, is autogenerated in both the laminator and in the subsequent stacking of insulation boards to insure complete curing of the core and surface coating of the facer.

As another embodiment involving the above operation, the top and bottom positioning of the facer sheets can be reversed so that the facer of this invention is fed and spaced above a conventional facer in a manner such that its non-coated fibrous surface faces the foamable insulating core chemical being contacted on its under surface with another facer sheet. The later procedure is practiced where one facer is a rigid sheet, as in a perlite or particle board facer as opposed to the flexible facer of this invention which can be fed to the laminator as a continuous roll. In this case the foamable insulating core chemical is surfaced on the rigid facer member and rises to engage the fibrous uncoated surface of the present facer.

In the above discussion, it will become apparent that it is also possible to form the insulation core separately, i.e. absent contact with the fibers of a facer, and subsequently bond one or more of the present facers to the core using suitable adhesives.

Polyurethane or polyisocyanurate are most commonly employed as core materials; although other non-elastomeric, foamable chemicals can also be employed. Examples of the later include polyvinyl chloride, polystyrene, phenolic resins and the like.

Figure 2:
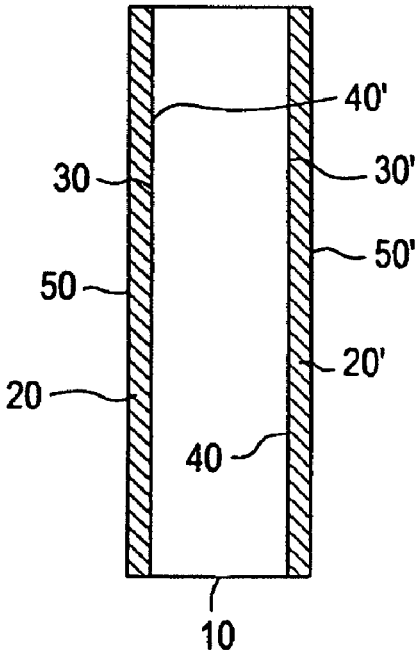
FIG. 2 shows a board and facer assembly according to the present invention.

As described above and shown in FIG. 2, the insulation board comprises a core material 10 as described above, with non-cellulosic mats, preferably fiberglass mats, 20 and 20', each of which preferably has filled and foamed latex coatings 30 and 30' on one side thereof. The non-cellulosic mats 20 and 20' are applied to the board faces 40 and 40'. The coatings side of the mats are fixed to board faces 40 and 40' leaving exposed the non-cellulosic material 50 and 50' present on the other side of the mats 20 and 20'.

Figure 3:
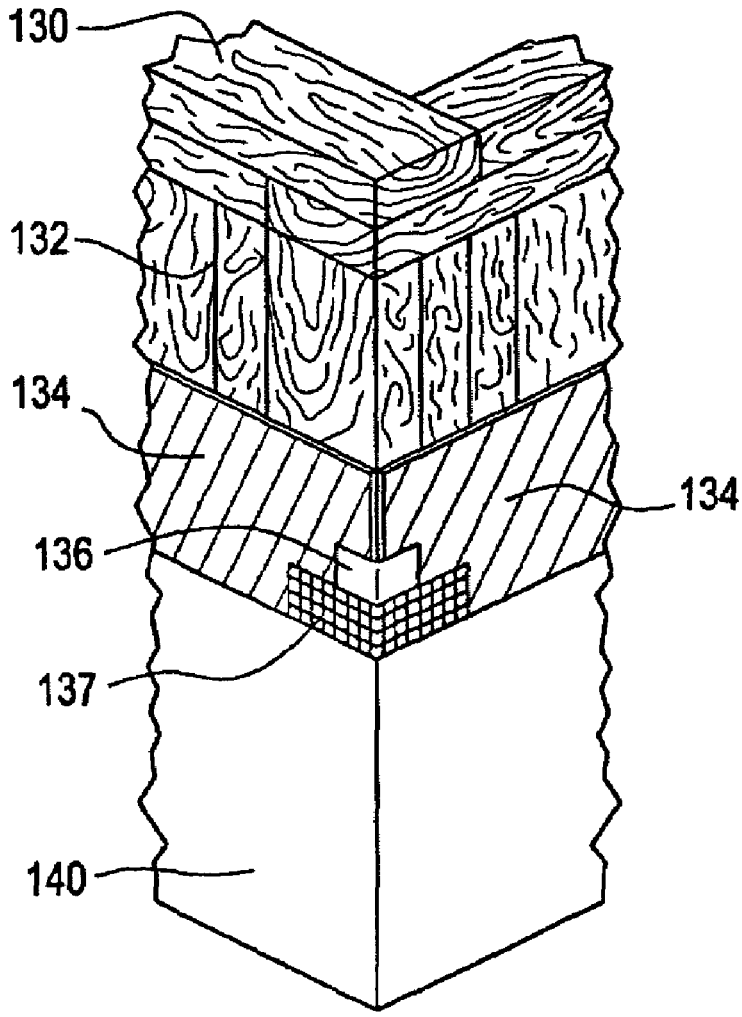
FIG. 3 is a cross sectional view of a building product using the board and facer according to the present invention.

Often in building construction, a wood frame is first covered with plywood undersiding. However, the frame and undersiding may be of brick, dry wall such as gypsum, concrete blocks, pre-cast concrete, insulation boards or other similar material. FIG. 3 is a cross sectional view of the building product using the board and facers described above according to the present invention. In this embodiment of the present invention, the frame consists of wood 130 to which a plywood undersiding 132 is fixed, usually by nails. The board 134, is fixed to the plywood. A metal corner 136 and fiberglass mesh 137 can be used for support at a corner. A water based vertical finish application 140, here stucco, is then applied to the board and reinforced corner. In this embodiment, the board 134 is faced with fiberglass mats each with filled and foamed latex wettings on their surfaces fixed to the board.

Optionally, a cement layer is applied onto-the exposed coating side of the assembly to smooth it before interposing a self-furring lathing, followed, optionally, with another cement layer. The construction then is finished with stucco or other such water based finishing application including but not limited to, Portland cement, cement, finishing plasters and other exterior cladding systems. Optionally, the undersiding may comprise dry wall such as gypsum, brick, concrete blocks, pre-cast concrete, or some type of insulation material. Acrylic finishes may also be applied to the finishing application.

Accordingly, it should be readily appreciated that the board, building product and method of the present invention has many practical applications. Additionally, although the preferred embodiments have been illustrated and described, it will be obvious to those skilled in the art that various modifications can be made without departing from the spirit and scope of this invention. Such modifications are to be considered as included in the following claims.

What is claimed is:

1. A building product comprising:

a composite board having a cellular, non-elastic core, top and bottom board surfaces, and a facer comprising a non-cellulosic fiber mat substrate; and a water-based overlaying material applied to the composite board;

wherein the non-cellulosic fiber mat has a first mat surface and a second mat surface coated with a prefoamed, self-sustaining foam mixture.

2. A building product as in claim 1 wherein:

the top and bottom board surfaces are fixed to the facer.

3. A building product as in claim 1 wherein:

one of the top and bottom board surfaces is fixed to the facer.

4. A building product as in claim 3 wherein:

one surface of the core is fixed to a cellulosic mat.

5. A building product as in claim 1 wherein:

the non-cellulosic fiber mat is a glass mat.

6. A building product as in claim 1 wherein:

the water-based overlaying material is a cementatious material.

7. A building product as in claim 6 wherein:

the cementatious material is Portland cement.

8. A building product as in claim 1 wherein:

the water-based overlaying material, is a finishing plaster.

9. A building product comprising:

an undersiding;

a composite board having a cellular, non-elastic core and top and bottom board surfaces and facer comprising a non-cellulosic fiber mat substrate fixed to the undersiding;

a reinforcing layer fixed to the board; and a water-based overlaying material applied to the reinforcing layer;

wherein the non-cellulosic fiber mat has a first mat surface and a second mat surface coated with a prefoamed, self-sustaining foam mixture.

10. A building product as in claim 9 wherein:

the undersiding comprises a plywood board.

11. A building product as in claim 9 wherein:

the undersiding comprises dry wall.

12. A building product as in claim 9 wherein:

the undersiding comprises concrete blocks.

13. A building product as in claim 9 wherein:

the undersiding comprises pre-cast concrete.

14. A building product as in claim 9 wherein:

the undersiding comprises insulation boards.

15. A building product as in claim 9 wherein:

the non-cellulosic fiber mat is a glass mat.

16. A building product as in claim 9 wherein:

the reinforcing layer is a self-furring lath.

17. A building product as in claim 9 wherein:
the reinforcing layer is a fiberglass mesh.

18. A building product as in claim 9 wherein:
the water-based overlaying material is cementatious.

19. A building product as in claim 20 wherein:
the cementatious material is Portland cement

20. A building product as in claim 9 wherein:
the water-based overlaying material is a finishing plaster.

21. A building product as in claim 9 further comprising:
a layer of cement between the undersiding and the reinforcing layer.

22. A building product as in claim 21 further comprising:
a layer of cement between the reinforcing layer and the finishing material.

* * * * *